US008816583B1

(12) United States Patent
Corazza et al.

(10) Patent No.: US 8,816,583 B1
(45) Date of Patent: Aug. 26, 2014

(54) MERCURY DOSING COMPOSITION

(71) Applicant: Saes Getters S.P.A, Lainate (IT)

(72) Inventors: Alessio Corazza, Como (IT); Diego Di Giampietro, Pescara (IT); Alberto Coda, Gerenzano (IT); Alessandro Gallitognotta, Origgio (IT)

(73) Assignee: Saes Getters S.p.A., Lainate (MI) (IT)

( * ) Notice: Subject to any disclaimer, the term of this patent is extended or adjusted under 35 U.S.C. 154(b) by 0 days.

(21) Appl. No.: 14/239,925

(22) PCT Filed: May 13, 2013

(86) PCT No.: PCT/IB2013/053876
§ 371 (c)(1),
(2), (4) Date: Feb. 20, 2014

(87) PCT Pub. No.: WO2013/179167
PCT Pub. Date: Dec. 5, 2013

(30) Foreign Application Priority Data

May 31, 2012 (IT) ..... MI2012A0940

(51) Int. Cl.

| | |
|---|---|
| ***H01J 17/24*** | (2012.01) |
| ***C22C 30/02*** | (2006.01) |
| ***H01J 61/28*** | (2006.01) |
| ***H01J 9/395*** | (2006.01) |

(52) U.S. Cl.
CPC ..... *H01J 61/28* (2013.01); *C22C 30/02* (2013.01); *H01J 9/395* (2013.01)
USPC ..... 313/558; 313/554; 313/565; 313/484

(58) Field of Classification Search
USPC ..... 313/554–558, 565, 484
See application file for complete search history.

(56) References Cited

U.S. PATENT DOCUMENTS

| | | | | |
|---|---|---|---|---|
| 3,203,901 | A | 8/1965 | Della Porto | |
| 3,657,589 | A | 4/1972 | Della Porta et al. | |
| 4,306,887 | A | 12/1981 | Barosi | |
| 5,825,127 | A | 10/1998 | Weinhardt | |
| 5,961,750 | A | 10/1999 | Boffito et al. | |
| 7,674,428 | B2 | 3/2010 | Coda et al. | |
| 2011/0163658 | A1* | 7/2011 | Corazza et al. | 313/484 |
| 2011/0204774 | A1* | 8/2011 | Riva et al. | 313/558 |

FOREIGN PATENT DOCUMENTS

| | | |
|---|---|---|
| EP | 0691670 | 1/1996 |
| GB | 2056490 | 3/1981 |
| WO | 97/19461 | 5/1997 |
| WO | 98/53479 | 11/1998 |
| WO | 2006/008771 | 1/2006 |
| WO | 2007/099575 | 9/2007 |
| WO | 2010/105945 | 9/2010 |
| WO | 2013/054251 | 4/2013 |

OTHER PUBLICATIONS

1-PCT International Search Report mailed on Oct. 17, 2013 for PCT Application PCT/IB2013/053876 filed on May 13, 2013 in the name of Saes Getters S.P.A.

2-PCT Written Opinion mailed on Oct. 17, 2013 for PCT Application PCT/IB2013/053876 filed on May 13, 2013 in the name of Saes Getters S.P.A.

* cited by examiner

*Primary Examiner* — Mary Ellen Bowman
(74) *Attorney, Agent, or Firm* — Steinfl & Bruno LLP

(57) ABSTRACT

An improved mercury dosing composition is described. A method for dispensing mercury with this composition and to discharge lamps containing each composition is also described.

15 Claims, 3 Drawing Sheets

MERCURY DOSING COMPOSITION

CROSS REFERENCE TO RELATED APPLICATIONS

The present application is the US national stage of International Patent Application PCT/IB2013/053876 filed on May 13, 2013 which, in turn, claims priority to Italian Patent Application MI2012A000940 filed on May 31, 2012.

The present invention, in a first aspect thereof, relates to an improved mercury dosing composition, in a second aspect thereof to a method for mercury dosing and in a third aspect thereof to a discharge lamp containing the improved mercury dosing composition.

Fluorescent lamps require for their operation the introduction of controlled, small amounts of mercury, however, due the toxicity of mercury, the regulations and constraints on its use have become more stringent with time. This requires to adopt better and more efficient methods for its dosing, both to minimize its use and also to have safer processes to avoid unwanted and premature mercury release.

Improved methods to introduce mercury in lamps exploit the use of dispensers based on mercury compounds that are stable at relatively low temperatures but can release the mercury by means of specific thermal activation just when the lamp is sealed. In particular, the release of mercury shall be avoided in the intermediate manufacturing steps that in the case of linear fluorescent lamps production may envision heating of the mercury dispenser to 400-500° C., while in the case of circular fluorescent lamps such temperature may be up to 600-650° C.

In this regard one of the earliest solutions adopted is the one described in U.S. Pat. No. 3,657,589, in the applicant's name, which showed a composition consisting of $Ti_xZr_yHg_z$ compounds. This solution, although innovative when made, showed some limits and improvements to it where made in the following years.

In particular, EP 0691670 and U.S. Pat. No. 7,674,428, both in the applicant's name, disclose improvements of the above-mentioned $Ti_xZr_yHg_z$ compounds by adding copper and additional elements, namely silicon in EP 0691670, while in U.S. Pat. No. 7,674,428 the additional elements are chosen from silicon, tin and chromium. Although the solution disclosed in U.S. Pat. No. 7,674,428 achieves improvements with respect to the hazards posed by the use of mercury and mercury compounds, there is still a need to improve this characteristic.

Avoiding or minimizing to the maximum extent the mercury release in high temperature intermediate process phases, i.e. 400-500° C. and up to 650° C. such as in the case of circular fluorescent lamps, ensures that the contamination risks and environmental hazards are minimized. However, at the same time there is the need to have solutions capable to guarantee a fast and efficient release of mercury when the temperature is raised at or above a certain threshold (i.e. 800° C.) by the heating means typically adopted (usually Radio Frequency heating systems).

The purpose of the present invention is to improve the results obtained with the compounds known in the art in terms of guaranteeing a high mercury yield and at the same time minimizing the premature release of mercury, and in a first aspect consist in a mercury dosing composition consisting of titanium, copper, silicon and mercury wherein:

mercury is comprised between 10 and 35 wt %, silicon is comprised between 1 and 10 wt %, the sum of titanium and copper is comprised between 55 and 89 wt % and the weight ratio between copper and titanium is comprised between 0.95 and 1.2.

A mercury dosing composition according to the present invention will be also defined in the following as a composition having the correct weight ratio, as per above specification.

Also, the mercury dosing composition according to the present invention although consisting of titanium, copper, silicon and mercury, may comprise and contain traces of unavoidable impurities (for example Fe, Mn, Zn as the most common ones) whose overall cumulative contribution is not higher than half of the minimum possible level for the elements of the dispensing composition, i.e. equal to or less than 0.5 wt %.

The invention will be further illustrated with the help of the following figures where:

Figure 1A:
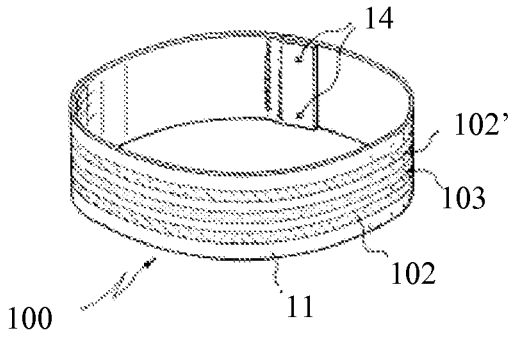
FIGS. 1A-1C show systems suitable to be used in the mercury dosing method according to the present invention.

The inventors have found that by choosing the proper element to be added, silicon, with the Cu/Ti weight ratio in a much narrower and specific interval with respect to what is disclosed in U.S. Pat. No. 7,674,428, it is possible to obtain a high mercury yield, higher than 90% at 800° C., and at the same time an improved stability at 400-500° C., therefore enhancing the safety of the industrial processes using such compositions.

The compositions of the present invention may be made by pre-alloying all the components, with the exception of mercury, and then exposing to mercury such pre-alloyed composition as described in U.S. Pat. No. 7,674,428, or by mixing powders of titanium, copper and silicon in the correct weight ratio and then exposing them to mercury.

All the mercury dosing compositions made according to the present invention are obtained after a conditioning process for the removal of excess mercury, such as for example the process described in U.S. Pat. No. 7,674,428.

In general the conditioning process envisions heating the mercury dosing composition under vacuum. Temperatures and especially heating times may vary a lot, with temperatures that typically range from 300° C. to 500° C., while times range from 1 to 300 min. Usually shorter times are used with higher temperatures and viceversa.

In a second aspect thereof the invention consists in a method for mercury dosing by heating for at least 15 seconds at a temperature of at least 800° C. a system comprising a metallic holder and at least a deposit of a mercury dosing composition consisting of titanium, copper, silicon and mercury wherein:

mercury is comprised between 10 and 35 wt %, silicon is comprised between 1 and 10 wt %, the sum of titanium and copper is comprised between 55 and 89 wt % and the weight ratio between copper and titanium is comprised between 0.95 and 1.2.

The method according to the present invention is not limited to a specific form or structure of the holder, even though the use of some type of supports acting as powders holder, such as the one based on flat metallic surfaces, is particularly advantageous.

Such metallic supports are known in the technical field and represent an advantageous means to incorporate the mercury source within the fluorescent lamps; they are described, for example, in WO 97/019461 in the applicant's name and in U.S. Pat. No. 5,825,127, whose teachings are herein incorporated by reference. One advantage of the compositions according to the invention is related to the fact that the adhesion of these mercury releasing powders on the metallic support is better than that of compounds known in the prior art. This feature allows a more stress-free and reliable handling and activation of the new dispensers without problems of possible particle loss.

Figure 3:
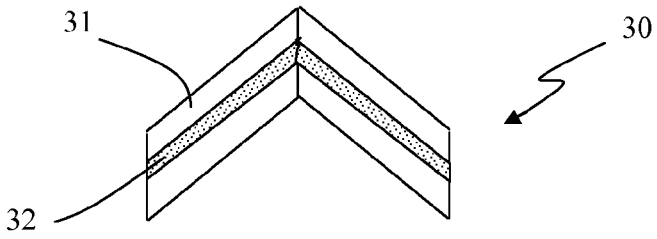

Another particularly advantageous holder shape for systems for carrying out the method according to the present invention is described in WO 98/053479 in the applicant's name with particular reference to the embodiment shown in FIG. 3. In this case the holder has a so-called wire form and its body may be characterized as presenting two lateral openings and a longitudinal slit.

Other materials, such as getter materials for the removal of impurities, may be deposited in the holder (in the case of wire-shaped holders) or on the holder (in the case of flat supports), together with the mercury dosing composition according to the present invention.

The term "deposit" is intended in its widest conception of aggregate, meaning that the mercury dosing composition according to the present invention may be present in the form of a layer (on flat supports) or a filler (in wire-shaped holders).

Examples of suitable getter materials are for example those described in U.S. Pat. No. 3,203,901 (Zr—Al alloys), U.S. Pat. No. 4,306,887 (Zr—Fe alloys), U.S. Pat. No. 5,961,750 (Zr—Co-Rare earths alloy). For hydrogen sorption, particularly at high temperatures, it is also known to use yttrium alloys, as described in WO 2007/099575 and WO 2010/105945, or a suitable mix of different getter material powders as described in the Italian patent application number MI2011A001870 in the applicant's name. The above-mentioned getter alloys are those preferably used with the mercury dosing composition according to the present invention, but any getter alloy used in powder form may be employed with the inventive concept herein disclosed.

Concerning the temperature for the mercury release from the system containing the mercury releasing composition according to the present invention, in general it is preferred not to exceed 920° C. in order to avoid significant outgassing from the metallic part of the support that may contaminate the lamp environment or, in the case of a getter material present on the support or on another lamp part, may prematurely reduce its gas sorption capacity.

FIG. 1A shows a first embodiment of a formed system 100 suitable to carry out the method of the invention. System 100 has a ring-like configuration and it is obtained by bending a metallic strip 11 acting as support and by spot welding the overlapped extremities of the support, such welding points being indicated by reference 14. On support 11 there are deposited two circumferential tracks 102, 102' of compressed powders of the mercury releasing composition according to the present invention and one track 103 of a getter material.

Figure 1B:
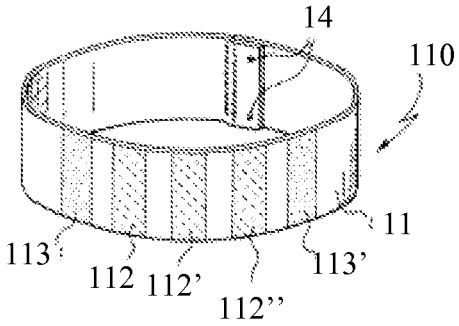

Number and arrangement of the tracks and of the fastening means for the support can vary without departing from the scope of the present invention. For example a first possible equivalent variant is shown in FIG. 1B, where in a system 110 the mercury dosing composition tracks 112, 112', 112" and the getter tracks 113, 113' are all parallel to each other and to the ring axis.

Figure 1C:
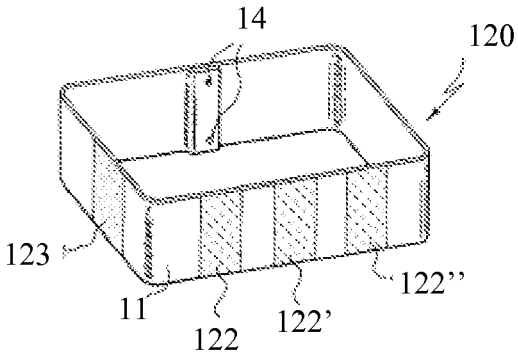

Another advantageous variant with regards to the given shape of the system is shown in FIG. 1C where the formed support 120 has a square-like shape with the tracks parallel to each other and to the support axis but with the mercury dosing composition tracks 122, 122', 122" and the getter material track 123 present on different sides of the support.

The tracks of the mercury dosing composition according to the present invention and the optional tracks of the getter material can be deposited by various means onto the flat metallic surfaces of the support before giving it its final shape. One of the preferred ways to produce the support is to deposit the tracks by means of the cold rolling technique, i.e. by depositing tracks of the materials in powder form on a substrate and then by passing over a compressing roll. The support is then cut in the desired length and given its final shape. The substrate is typically made of a metallic material, for example suitable materials are nickel-plated iron, nickel-iron alloys, stainless steel.

With this technique it is particularly advantageous to have the size of the powders (to be intended as maximum transverse dimension of the powders) equal to or less than 300 μm. Such powder grain size can be easily selected by means of a simple sieving operation and the use of sieves with smaller openings enables to select particles distribution with a lower grain size.

As to the tracks width this is advantageously comprised between 1 and 10 mm, being intended as an average width since it is slightly non-uniform due to the fact that is defined by discrete particles. As to the tracks height this is advantageously less than 0.5 mm, the lowest limit being given by the height of a particle monolayer.

Figure 2A:
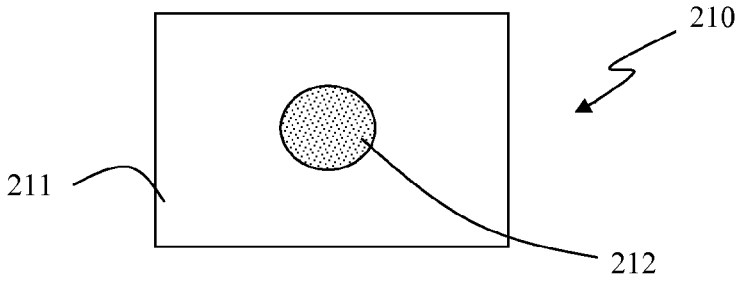
FIGS. 2A-2C and 3 show alternate embodiments of systems suitable to be used in the mercury dosing method according to the present invention.

Another variant of the support is shown in FIG. 2A where the final formed shape of the support 211 of system 210 is squared or rectangular with a depression, obtained by deep drawing on the metallic base of the support 211, where there is located a layer of pressed mercury releasing powders 212.

Figure 2B:
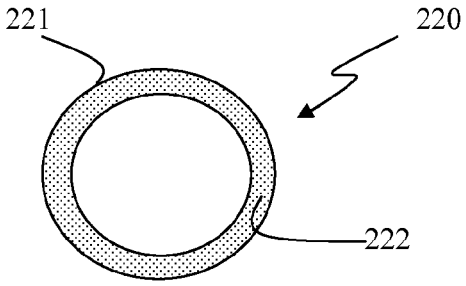
Figure 2C:
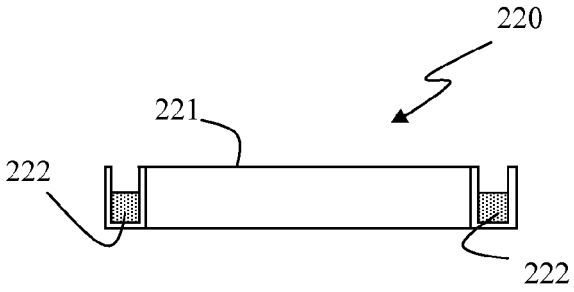

FIG. 2B shows a view from above of another possible configuration for system 220, in this case the support 221 has a ring-like shape with the mercury dosing composition 222 present in the form of compressed powders within the U-shaped ring cavity. As illustrated in FIG. 2C, showing a vertical cross-section of system 220, the mercury dosing compositions 222 may only partially fill the volume available in the support, i.e. the height of the compressed powders is less than the support ring height. In the two embodiments of FIGS. 2A and 2B-2C it is possible that also a getter material (not depicted) is added to the mercury dosing composition. In this case the most useful way to insert it is by mixing with the mercury dosing composition according to the present invention, even though the getter material may also be added as an underlying and/or overlapping layer of compressed powders.

Another advantageous variant for a system 30 comprising the mercury dosing composition to carry out the method according to the present invention is shown in FIG. 3. In this case the metallic base 31 of the support is given a V shape by folding it approximately at the center, and a track 32 of mercury releasing powders according to the present invention is deposited thereon; in another variant (not shown) the V-shaped support 31 can receive a track of mercury releasing powders and a track of getter alloy.

Figure 4:
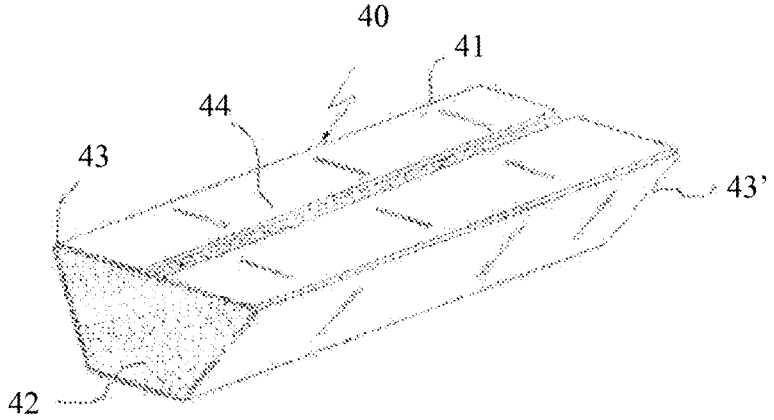
FIG. 4 shows an alternate embodiment of a system suitable to be used in the mercury dosing method according to the present invention, having a different holder structure.

FIG. 4 shows a system 40 in wire form suitable to be used in the method according to the present invention, the system being made of a metallic holder 41 having a trapezoidal shape that contains the compressed powders 42 of the mercury dosing composition. The holder presents two lateral openings 43 and 43', and a third opening 44 in the form of a slit running along one of the faces of the metallic holder. The trapezoidal shape of the metallic holder depicted in FIG. 4 is a non-limiting example, other shapes being functionally equivalent, such as a square or a cylindrical one.

In a third aspect thereof the invention consists in a lamp containing a system comprising a metallic holder that carries a deposit of a mercury dosing composition consisting of titanium, copper, silicon and mercury wherein:

mercury is comprised between 10 and 35 wt %, silicon is comprised between 1 and 10 wt %, the sum of titanium and copper is comprised between 55 and 89 wt % and the weight ratio between copper and titanium is comprised between 0.95 and 1.2.

The system may also comprise other materials, advantageously getter materials as previously defined. The support may have various shapes and forms, even though the most useful ones are those previously described.

Figure 5:
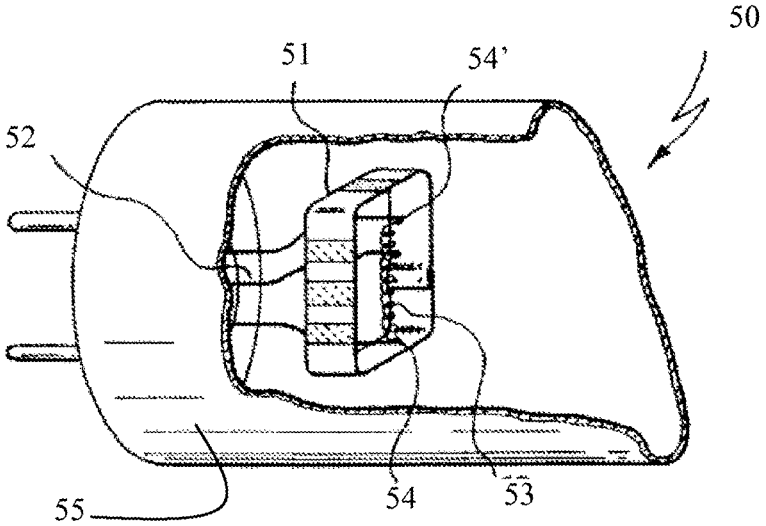
FIG. 5 shows a schematic representation of a lamp made according to the present invention.

In particular, FIG. 5 shows a lamp 50 in which the mercury dosing system 51 is fixed onto the so-called third electrode 52 of the lamp and surrounds the lamp filament 53 and the terminal part of its contacts 54, 54' without touching any of these three elements. System 51 provides also a shielding action with respect to material emitted by filament 53 during lamp operation that may blacken or darken the coated lamp glass enclosure 55. In lamp 50 a system as represented in FIG. 1C is used, but any other suitable system with different holder shape may be used and also such systems, with particular and non-exclusive reference to those shown in FIGS. 2 and 3, may be placed and mounted in different positions within the lamp.

The invention will be further illustrated with the help of the following non-limiting example.

EXAMPLE 100 grams of a mercury dosing composition 51 according to the present invention made of 32.2 wt % Ti, 36.4 wt % Cu, 1.4 wt % Si, 30 wt % Hg are prepared according to the following process:

titanium granules, copper powder and silicon powder with weight percentages of 46%, 52% and 2% wt, respectively, are melted in an induction furnace under inert atmosphere, then the obtained ingot is milled;

the produced powders are sieved in order to choose only grains whose size is smaller than 125 μm, and 70 grams of these powders are mechanically mixed with 31 grams of liquid mercury, introduced and sealed in a crucible under argon atmosphere;

the crucible is then inserted in a furnace and submitted to heating up to 700° C. for 3 hours with some heating steps at 500° C. and 600° C. and to natural cooling to room temperature in about 6 hours;

Then after opening of the furnace the compact body of the composition is extracted from the crucible. Finally, the mercury dosing composition is subjected to a treatment for the removal of non-binded mercury, obtaining the reported weight ratio. Such treatment consists in heating at 320° C. for 4 hours under vacuum (pressure below $1*10^{-3}$ mbar) after a long ramp-up time of about 6 hours.

The same process is used to obtain a sample of another mercury dosing composition S2 made according to the present invention and comparative samples C1, C2 and C3, whose characteristics are reported in table 1.

TABLE 1

| Sample ID | Ti | Cu | Si | Hg | Cu/Ti |
|---|---|---|---|---|---|
| S1 | 32.2 | 36.4 | 1.4 | 30 | 1.13 |
| S2 | 31.2 | 35.3 | 3.5 | 30 | 1.13 |
| C1 | 28.5 | 37.8 | 3.7 | 33 | 1.33 |
| C2 | 29.5 | 39.1 | 1.4 | 30 | 1.33 |
| C3 | 35.9 | 30.6 | 3.5 | 30 | 0.85 |

Samples S1 and S2 have a Cu/Ti weight ratio according to the present invention, while samples C1 and C2 are comparative examples since their Cu/Ti weight ratio is higher than 1.2; C3 is also a comparative example because its Cu/Ti weight ratio is lower than 0.95.

The five compositions are then evaluated in terms of Hg yield at 800° C. and Hg loss at 400° C. In order to measure Hg yield and Hg loss, six specimens for each composition are prepared by pressing the powders in small metallic rings. For each composition three specimens are inductively heated in a glass bulb under vacuum (pressure below $1*10^{-3}$ mbar) at 800° C. for 20 seconds after a ramp-up time of 10 seconds. The weight difference of the specimen after the applied heating process indicates the mercury release and, knowing the initial Hg content, the Hg yield is thus determined.

For the other three specimens for each composition the Hg loss is determined in the same way by weight difference: in this case the rings are heated in a glass bulb under vacuum at 400° C. for 2 minutes after a ramp-up time of 10 seconds. The sensitivity limit of the weight difference measurement technique is about 0.3% and in some cases the results of Hg loss tests are below this limit. Data of average Hg yield obtained during activation at 800° C. and of average Hg loss at 400° C. are reported in table 2.

TABLE 2

| Sample ID | Hg Yield | Hg Loss |
|---|---|---|
| S1 | 93.5% | <0.3% |
| S2 | 95% | <0.3% |
| C1 | 95% | 3.10% |
| C2 | 93% | 3.00% |
| C3 | 87% | <0.3% |

All the samples show very good Hg yields, with the exception of C3 that has a Hg yield lower than 90%, however only the samples made according to the present invention show a Hg yield higher than 93% combined with a negligible mercury loss at 400° C.

It has to be underlined that comparative samples C1 and C2 are made according to the previously mentioned U.S. Pat. No. 7,674,428, according to example 1 with the only difference that the pre-conditioning step was milder (320° C. instead of 500° C.).

This shows that the alloys of the present invention are less dependent from the pre-conditioning step characteristic, resulting in more stable alloys, and this result is achieved without compromising the yield at 800° C.

The invention claimed is:

1. A mercury dosing composition consisting of titanium, copper, silicon and mercury, wherein:

mercury is comprised between 10 and 35 wt %, silicon is comprised between 1 and 10 wt %, the sum of titanium and copper is comprised between 55 and 89 wt %, and the weight ratio between copper and titanium is comprised between 0.95 and 1.2, and an overall cumulative content of traces of unavoidable impurities is equal to or less than 0.5 wt %.

2. A method for producing the mercury dosing composition according to claim 1, wherein said composition is made by:

pre-alloying all the components with the exception of mercury, and exposing to mercury such pre-alloyed composition.

3. A method for producing the mercury dosing composition according to claim 1, wherein said composition is made by:

pre-mixing the elements in powder form with the exception of mercury, and exposing to mercury such pre-mixed powders.

4. A method for mercury dosing, comprising:

heating a system for at least 15 seconds at a temperature of at least 800° C., the system comprising:

a metallic holder and at least a deposit of a mercury dosing composition according to claim 1.

5. The method according to claim 4, wherein said temperature is comprised between 800° C. and 900° C.

6. The method according to claim 4, wherein the mercury dosing composition is in the form of powders with a size equal to or less than 300 μm.

7. The method according to claim 6, wherein said powders are deposited on the metallic holder.

8. The method according to claim 7, wherein said powders are deposited in the form of tracks with a width comprised between 1 mm and 10 mm and a height equal to or less than 0.5 mm.

9. The method according to claim 6, wherein said powders are deposited in a metallic holder having two lateral openings and a longitudinal slit.

10. The method according to claim 7, wherein said powders are compressed in a metallic holder shaped like a ring.

11. The method according to claim 4, wherein the system further comprises one or more getter materials.

12. The method according to claim 11, wherein said one or more getter materials are mixed with the mercury dosing composition.

13. The method according to claim 11, wherein said one or more getter materials are separated from said mercury dosing composition.

14. A lamp containing a mercury dosing system comprising a metallic holder and at least a deposit of a mercury dosing composition according to claim 1.

15. The lamp according to claim 14, wherein said system comprises one or more getter materials.

* * * * *